US008755533B2

(12) United States Patent
Banerjee et al.

(10) Patent No.: US 8,755,533 B2
(45) Date of Patent: Jun. 17, 2014

(54) AUTOMATIC PERFORMANCE OPTIMIZATION FOR PERCEPTUAL DEVICES

(75) Inventors: Bonny Banerjee, Palm Bay, FL (US); Lee Krause, Indialantic, FL (US)

(73) Assignee: Cochlear Ltd., Macquarie University (AU)

( * ) Notice: Subject to any disclaimer, the term of this patent is extended or adjusted under 35 U.S.C. 154(b) by 1169 days.

(21) Appl. No.: 12/185,394

(22) Filed: Aug. 4, 2008

(65) Prior Publication Data

US 2010/0027800 A1 Feb. 4, 2010

(51) Int. Cl.
*H04R 29/00* (2006.01)
*H04R 25/00* (2006.01)

(52) U.S. Cl.
USPC ..... 381/58; 381/60; 381/314; 600/559

(58) Field of Classification Search
USPC ..... 381/58, 60, 312, 314, 320, 321, 323; 600/559; 607/56, 57
See application file for complete search history.

(56) References Cited

U.S. PATENT DOCUMENTS

| | | | |
|---|---|---|---|
| 4,049,930 | A | 9/1977 | Fletcher et al. |
| 4,327,252 | A | 4/1982 | Tomatis |
| 5,008,942 | A | 4/1991 | Kikuchi |
| 5,729,658 | A | 3/1998 | Hou et al. |
| 6,035,046 | A | 3/2000 | Cheng et al. |
| 6,036,496 | A | 3/2000 | Miller et al. |
| 6,118,877 | A | 9/2000 | Lindermann et al. |
| 6,446,038 | B1 | 9/2002 | Bayya et al. |
| 6,684,063 | B2 | 1/2004 | Berger et al. |
| 6,763,329 | B2 | 7/2004 | Brandel et al. |
| 6,823,171 | B1 | 11/2004 | Kaario |
| 6,823,312 | B2 | 11/2004 | Mittal et al. |
| 6,913,578 | B2 | 7/2005 | Hou |

(Continued)

FOREIGN PATENT DOCUMENTS

| | | |
|---|---|---|
| DE | 2349626 | 4/1975 |
| EP | 0714069 | 5/1996 |

(Continued)

OTHER PUBLICATIONS

Rabiner, et al. "A Tutorial on Hidden Markov Models and Selected Applications in Speech Recognition," vol. 77, No. 2, Feb. 1989, pp. 257-269.

(Continued)

*Primary Examiner* — Matthew W Such
*Assistant Examiner* — Scott Stowe
(74) *Attorney, Agent, or Firm* — Merchant & Gould P.C.

(57) ABSTRACT

Systems and methods may be used to modify a controllable stimulus generated by a digital audio device in communication with a human user. An input signal is provided to the digital audio device. In turn, the digital audio device sends a stimulus based on that input signal to the human user, who takes an action, usually in the form of an output signal, to characterize the stimulus that the user receives, based on the user's perception. An algorithm, lookup table, or other procedure then determines a difference between the input signal and the output signal, and a perceptual model is constructed based at least in part on the difference. Thereafter, a new value for the parameter of the digital audio device is suggested based at least in part on the perceptual model. This process continues iteratively until the user's optimal device parameters are determined.

20 Claims, 5 Drawing Sheets

(56) References Cited

U.S. PATENT DOCUMENTS

| | | | | |
|---|---|---|---|---|
| 6,914,996 | B2 | 7/2005 | Takeda | |
| 7,206,416 | B2 | 4/2007 | Krause et al. | |
| 2002/0120440 | A1 | 8/2002 | Zhang | |
| 2002/0183648 | A1 * | 12/2002 | Hou | 600/559 |
| 2003/0007647 | A1 | 1/2003 | Nielsen et al. | |
| 2005/0027537 | A1 | 2/2005 | Krause et al. | |
| 2006/0045281 | A1 | 3/2006 | Korneluk et al. | |
| 2007/0286350 | A1 | 12/2007 | Krause et al. | |
| 2010/0027800 | A1 | 2/2010 | Banerjee et al. | |
| 2010/0299148 | A1 | 11/2010 | Krause et al. | |

FOREIGN PATENT DOCUMENTS

| | | |
|---|---|---|
| EP | 1519625 | 3/2005 |
| JP | 2002-291062 | 10/2002 |
| WO | WO 98/44762 | 10/1998 |
| WO | WO-99/31937 | 6/1999 |
| WO | WO 2005/062776 | 7/2005 |

OTHER PUBLICATIONS

International Search Report for International Application No. PCT/US2009/052633, mailed from the International Search Authority on Dec. 29, 2009, 4 pgs.

Skowronski, et al., "Exploiting independent filter bandwidth of human factor cepstral coefficients in automatic speech recognition," J. Acoustical Society of America, vol. 116, No. 3, pp. 1774-1780, Sep. 2004.

Skowronski, M. D. et al., "Applied principles of clear and Lombard speech for intelligibility enhancement in noisy environments," Speech Communication, vol. 48, No. 5, pp. 549-558, May 2006.

* cited by examiner

AUTOMATIC PERFORMANCE OPTIMIZATION FOR PERCEPTUAL DEVICES

FIELD OF THE INVENTION

This invention relates to systems and methods for optimizing performance of perceptual devices to adjust to a user's needs and, more particularly, to systems and methods for adjusting the parameters of digital hearing devices to customize the output from the hearing device to a user.

BACKGROUND OF THE INVENTION

Perception is integral to intelligence. Perceptual ability is a prerequisite for any intelligent agent, living or artificial, to function satisfactorily in the real world. For an agent to experience an external environment with its perceptual organs (or sensors, in the case of artificial agents), it sometimes becomes necessary to augment the perceptual organs, the environment, or both.

For example, human eyes are often augmented with a pair of prescription glasses. In another example, to experience surround-sound in a car or in a home theater, the environment is augmented with devices, such as speakers and sub-woofers, placed in certain positions with respect to the agent. To experience a 3D movie, the agent often has to wear specially designed eyeglasses, such as polarized glasses. These and other devices including, without limitation, audio headphones, hearing aids, cochlear implants, low-light or "night-vision" goggles, tactile feedback devices, etc., may be referred to generally as "perceptual devices."

Due to personal preference, taste, and the raw perceptual ability of the organs, the quality of experience achieved by augmenting the agent's perceptual organs or environment with devices is often user-specific. As a result, the devices should be tuned to provide the optimum experience to each user.

With the advent of sophisticated perceptual devices, each having a large number of degrees of freedom, it has become difficult to tune such devices to the satisfaction of each user. Many devices are left to the user for ad-hoc self-tuning, while many others are never tuned because the time and cost required to tune a device for a user may be too high. For example, cochlear implant devices, often used by people having severe hearing-impairment, are virtually never tuned by an audiologist to a particular user, but instead are left with the factory default settings to which the user's brain must attempt to adjust. Thus, a hearing-impaired person may never get the full benefit of his cochlear implant.

Agents with simple perceptual systems (e.g., robotic vacuum cleaners) have sufficient transparency to allow for the tracking of their raw perceptual abilities, while agents with complex perceptual systems (e.g., humans) lack that transparency. Hence, it is extremely difficult to tune devices to the satisfaction of members of the latter class of users, because of the complexity of the devices that enhance an already complex perceptual system.

A sophisticated perceptual device should also allow the user to tune the device to meet that user's particular perceptual needs. Such complex devices often have a large set of parameters that can be tuned to a specific user's needs. Each parameter can be assigned one of many values, and determining the values of parameters for a particular user's optimum performance is difficult. A user is required to be thoroughly tested with the device in order to be assigned the optimum parameter values. The number of tests required increases exponentially with the number of device parameters. Dedicating a significant amount of time to testing often is not a feasible option; accordingly, it is may be advantageous to reduce the complexity of the problem.

Therefore, there is a need to automatically tune perceptual devices in a user-specific way. As of today, living agents, especially humans, have complex perceptual systems that can take advantage of a user-specific tuning method. Artificial agents with complex perceptual systems, when developed, will also benefit from the user-specific tuning method.

SUMMARY OF THE INVENTION

In one aspect, the invention relates to a method for modifying a controllable stimulus generated by a perceptual device in communication with a human user, the method including: generating an input signal to the perceptual device, the perceptual device sending a stimulus to the human user, the stimulus defined at least in part by a parameter, the parameter having a value; receiving an output signal from the human user, the output signal based at least in part on a perception of the stimulus by the human user; determining a difference between the input signal and the output signal; constructing a perceptual model based at least in part on the difference; and suggesting a value for the parameter based at least in part on the perceptual model. In one embodiment, suggesting a value further includes utilizing a knowledge base. In another embodiment, the knowledge base includes at least one of declarative knowledge and procedural knowledge. In yet another embodiment, the method further includes generating a second input signal to the perceptual device based at least in part on the perceptual model. In other embodiments, the input signal is an audio signal, and/or the perceptual device is a digital audio device.

In another aspect, the invention relates to a system for modifying a controllable stimulus generated by a perceptual device in communication with a human user, the system including: a test set generator for generating a test set to the perceptual device, the perceptual device sending a stimulus to the human user, the stimulus defined at least in part by a parameter, the parameter including a value; a signal receiver for receiving an output signal from the human user, the output signal based at least in part on a perception of the stimulus by the human user; a perceptual model module for constructing a perceptual model based at least in part on the difference; and a parameter generator for suggesting a value for the parameter based at least in part on the perceptual model. In an embodiment of the above aspect, the system further includes a second signal generator for generating a second input signal to the perceptual device based at least in part on the perceptual model. In another embodiment, the system further includes a storage module for storing information used in the construction of the perceptual model. In yet another embodiment, the information stored in the storage module includes a knowledge base. In still another embodiment, the system includes a rule extraction module for formulating a rule based at least in part on the perceptual model. In another embodiment of the above aspect, the parameter generator suggests a value for the parameter based at least in part on at least one of information obtained from the storage module and information obtained from the perceptual model module. In another embodiment, the signal generator includes the second signal generator. In yet another embodiment the input signal is an audio signal.

In another aspect, the invention relates to an article of manufacture having computer-readable portions embodied thereon for modifying a controllable stimulus generated by a perceptual device in communication with a user, the article including: computer readable instructions for providing an input signal to the perceptual device, the perceptual device sending a stimulus to the human user, the stimulus defined at least in part by a parameter, the parameter having a value; computer readable instructions for receiving an output signal from the agent, the output signal based at least in part on a perception of the stimulus by the human user; computer readable instructions for determining a difference between the input signal and the output signal; computer readable instructions for constructing a perceptual model based at least in part on the difference; and computer readable instructions for suggesting a value for the parameter based at least in part on the perceptual model. In an embodiment of the above aspect, the article of manufacture further includes computer readable instructions for providing a second input signal to the perceptual device based at least in part on the perceptual model. In another embodiment, the input signal is an audio signal.

BRIEF DESCRIPTION OF THE DRAWINGS

Other features and advantages of the present invention, as well as the invention itself, can be more fully understood from the following description of the various embodiments, when read together with the accompanying drawings, in which.

DETAILED DESCRIPTION OF THE INVENTION

Figure 1:
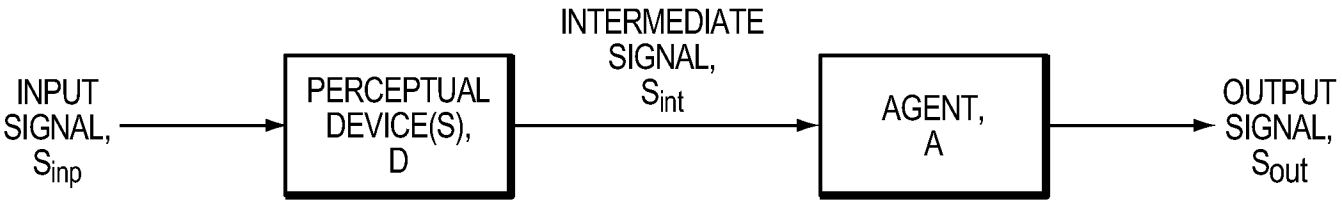
FIG. 1 is a schematic diagram depicting the relationship between a perceptual device and an agent in accordance with one embodiment of the present invention.

Various embodiments of the methods and systems disclosed herein are used to "tune" a perceptual device. In this application, the term "optimization" is sometimes used to describe the process of tuning, which typically includes modifying parameters of a perceptual device. However, one of ordinary skill in the art would understand that the disclosed methods and systems may be used to "modify" the parameters of a device without achieving "optimization." That is, there may be instances where limitations of a device, or of user perception, may prevent complete optimization of a parameter, where "optimization" could be characterized as obtaining perfect or near-perfect results.

Another consideration is that the testing associated with the tuning process may stop short when the tester becomes tired or otherwise stops the test, without completely "optimizing" the device. True "optimization" may not be necessary or desirable, as even seemingly minor improvements or modifications to a device parameter may produce significant positive results for a device user. Accordingly, the terms "optimization," "modification," "tuning," "adjusting," and like terms are used herein interchangeably and without restriction to describe systems and methods that are used to modify parameters of a perceptual device, notwithstanding whether the output from the device is ultimately "optimized" or "perfected," as those terms are typically understood.

Certain embodiments of the disclosed methods and systems automatically tune at least one device parameter based on a user's raw perceptual ability to improve the user's perception utilizing different tuning algorithms operating separately or in tandem to allow the device to be tuned quickly. The device parameters can be user-specific or user-independent. In one embodiment of the optimization method, a model is created to describe a user's perception (i.e., the perceptual model). This model is incremental and is specific to a user and his device. Next, one or more algorithms is applied to the model resulting in predictions (along with confidence and explanation) of the optimum parameter values for the user. Then, the user is iteratively tested with the values having the highest confidence, and the model is further updated. Last, a set of rules capturing user-independent information is used to tune certain parameters.

The number of parameters governing the operation of a given perceptual device may be large. The amount of data required to faithfully model a user's perceptual strengths and weaknesses using that device increases exponentially with the number of device parameters; this limits the ability to reach optimal settings for the device in a reasonable time. In one embodiment, a number of algorithms are used with simple independent assumptions regarding the model. Using these assumptions, each algorithm studies the model and makes predictions with a confidence. The most confident prediction is chosen at any point of time. This architecture helps reduce the complexity of the solution that otherwise would have been enormous. In other embodiments, lookup tables or other procedures may be utilized to perform the optimization, in much the same way as the algorithms described above.

In this context, a user may be considered a black box with perceptual organs that can accept a signal as input and produce a signal as output in accordance with certain instructions. This method is useful for applications where the black box is too complex to be modeled non-stochastically, such as the human brain. Depending on the nature of the "black box," the instructions can be conveyed by different means. For example, a human might be told instructions in a natural language; an artificial agent might be programmed with the instructions.

Raw perception of a user is judged by some criteria that measure the actual output signal against the output signal expected from the application of the given set of instructions to the input signal. For example, if the input signals are spoken phonemes, the black box is a human brain with ears as the perceptual organs, and the instruction is to reproduce the input phonemes (as speech or in writing), the perception might be measured by computing the difference between the input and output phonemes. In another example, if the input signal is a set of letters written on a piece of paper, the black box is a human brain with eyes as the perceptual organs, and the instruction is to reproduce the letters (as speech or in writing), the perception might be measured by computing the difference between the input and output letters. It is assumed that the instructions have been correctly conveyed and are being followed by the black box.

FIG. 1 depicts an exemplary relationship between the perceptual device D and the agent A. Given a user or an agent A, one or more devices D, an input signal $S_{inp}$, and a corresponding output signal $S_{out}$ that the agent has produced obeying certain instructions, FIG. 1 depicts the relationships:

$$D(S_{inp})=S_{int}$$

$$A(S_{int})=S_{out}$$

$$\therefore A(D(S_{inp}))=S_{out}$$

where $S_{int}$ is the intermediate signal or stimulus emanated from the device(s) and perceived by the agent. In the case of a digital audio device, the stimulus is the sound actually heard by the user. The intermediate signal cannot be measured in the same way that $S_{inp}$ and $S_{out}$ are susceptible of measurement. It is desired that $S_{inp}=S_{out}$, hence A(D(.))=I(.) where I(.) is the identity function.

In a typical application of the current invention, almost nothing is known about the function A. The function D is characterized by the device parameters. Embodiments of the present invention (1) statistically model the perceptual errors (i.e., some metric applied to $S_{inp}$~$S_{out}$) for an agent with respect to the device parameters, and (2) study this perceptual model to predict the best set of parameter values. Ideally, the predicted parameter values render $S_{inp}=S_{out}$ for any $S_{inp}$ for the agent and the device. Thus, in general, the present invention proposes a general method for estimating the function A(D(.)) where minimal knowledge is available regarding function A.

Figure 2:
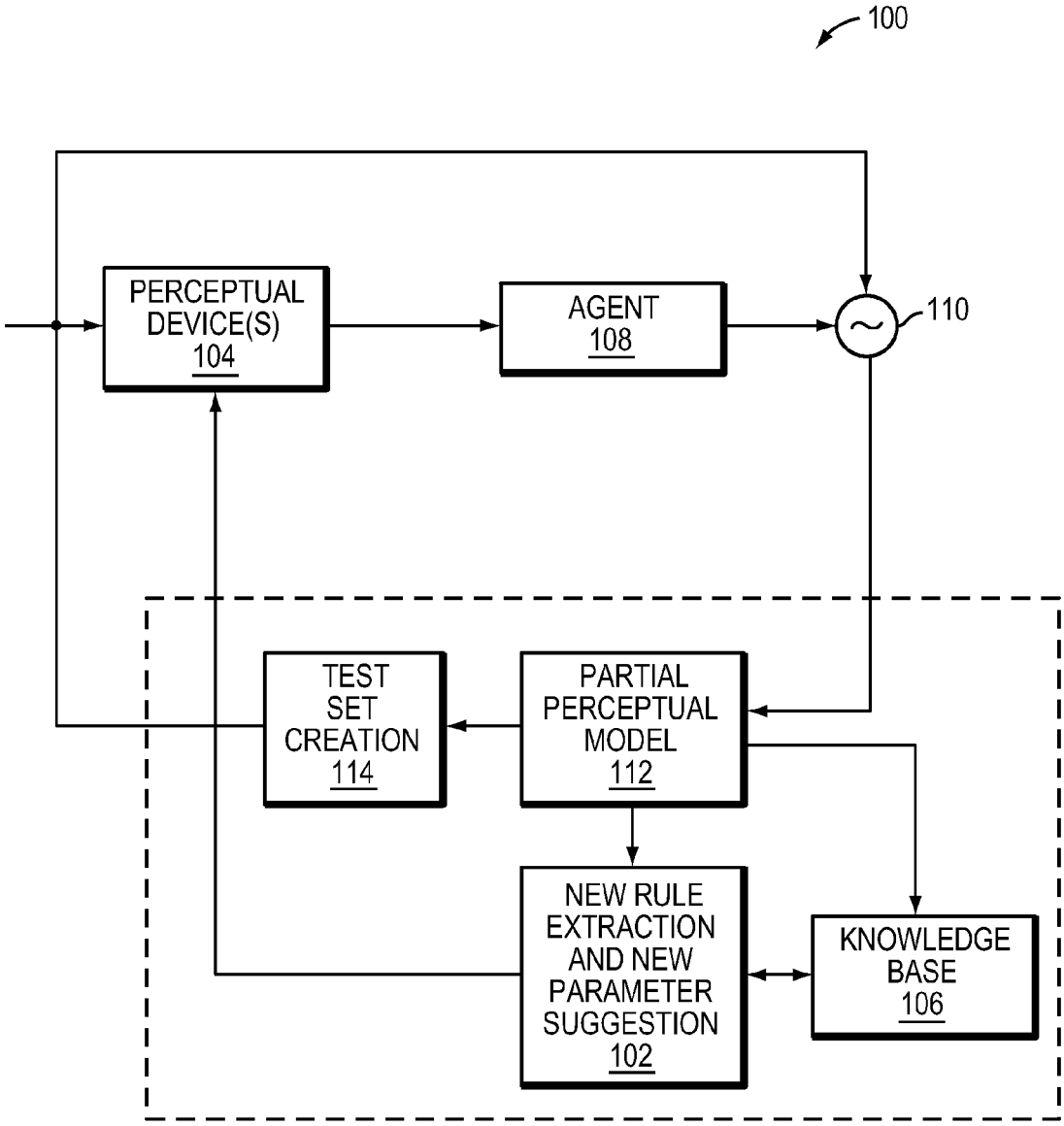
FIG. 2 is a schematic diagram of an apparatus in accordance with one embodiment of the present invention.

In one embodiment of the present invention, a method is provided for automatically tuning the parameters of at least one perceptual device in a user-specific way. The agent or its environment is fitted with a device(s) whose parameters are preset, for example, to factory default values. The proposed method may be implemented as a computer program that tests the raw perception of the agent. FIG. 2 depicts one such implementation of the program 100. Based on the results of the test, the program 100 may suggest new parameter values along with an explanation of why such values are chosen and the confidence of the suggested set of values 102. The devices 104 are reset with the parameter values with the highest confidence or best explanation. If a human tester (for example, an audiologist fine tuning a digital hearing aid or cochlear implant (CI)) is conducting the test using the computer program 100, he might decide to disregard the suggested set of values and set his own values if he finds the suggested parameter values and the explanation not particularly useful. Such a decision on the part of the tester is based generally on the tester's expert domain knowledge. In such a situation, the knowledge base 106 of the program 100 is updated with the knowledge of the expert used in determining an alternative set of values. At each iteration of the program 100, the agent 108 is tested with a new set of parameter values and, after testing, the program 100 suggests a new set of parameters. This procedure continues until a certain set of parameter values is obtained that helps the agent 108 perceive satisfactorily. Particularly advanced programs, utilizing a number of algorithms, may be able to suggest the optimum set of parameter values within a very short period of testing. Other programs may utilize lookup tables or other procedures to suggest the optimum set of parameters.

The purpose of testing is to determine the raw perceptual ability, independent of context and background knowledge, of the agent 108. A series of input signals is presented to the agent 108 whose environment is fitted with at least one perceptual device 104 set to certain parameter values. After each signal is presented, the agent 108 is given enough time to output a signal in response to its perceived signal, in accordance with instructions that the agent 108 has previously received. The output signal 110 corresponding to each input signal is recorded along with the time required for response. A metric captures the difference between the input signal and the agent's response in a meaningful way such that a model 112 of the agent's perceptual ability can be incrementally constructed using that metric and the device parameters.

At the end of each iteration, the test set creator or generator 114, utilizing one or more algorithms, lookup tables, or other procedures, modifies the parameters based on information received during the test. The next set of input signals are chosen on which the agent 108 should be tested, based on its strengths and weaknesses as evident from the model 112. A new test starts with the perceptual devices 104 set to new parameter values, again, based on the application of the algorithm to the information. An increase in response time indicates that either the agent 108 is having difficulty in perception or the agent 108 is getting fatigued. In the latter case, the agent 108, tester, or program 100 may opt to rest before further testing.

The model 112 describes the perceptual ability of the agent 108 with respect to the perceptual devices 104. Given an accurate model, one can predict the parameter values best suited for an agent 108. However, the model 112 is never complete until the agent 108 has been tested with all combinations of values for the parameters. Such testing is not feasible in a reasonable time for any complicated device. The model 112 is incremental and thus each prediction is based on the incomplete model derived prior to that iteration.

Figure 3:
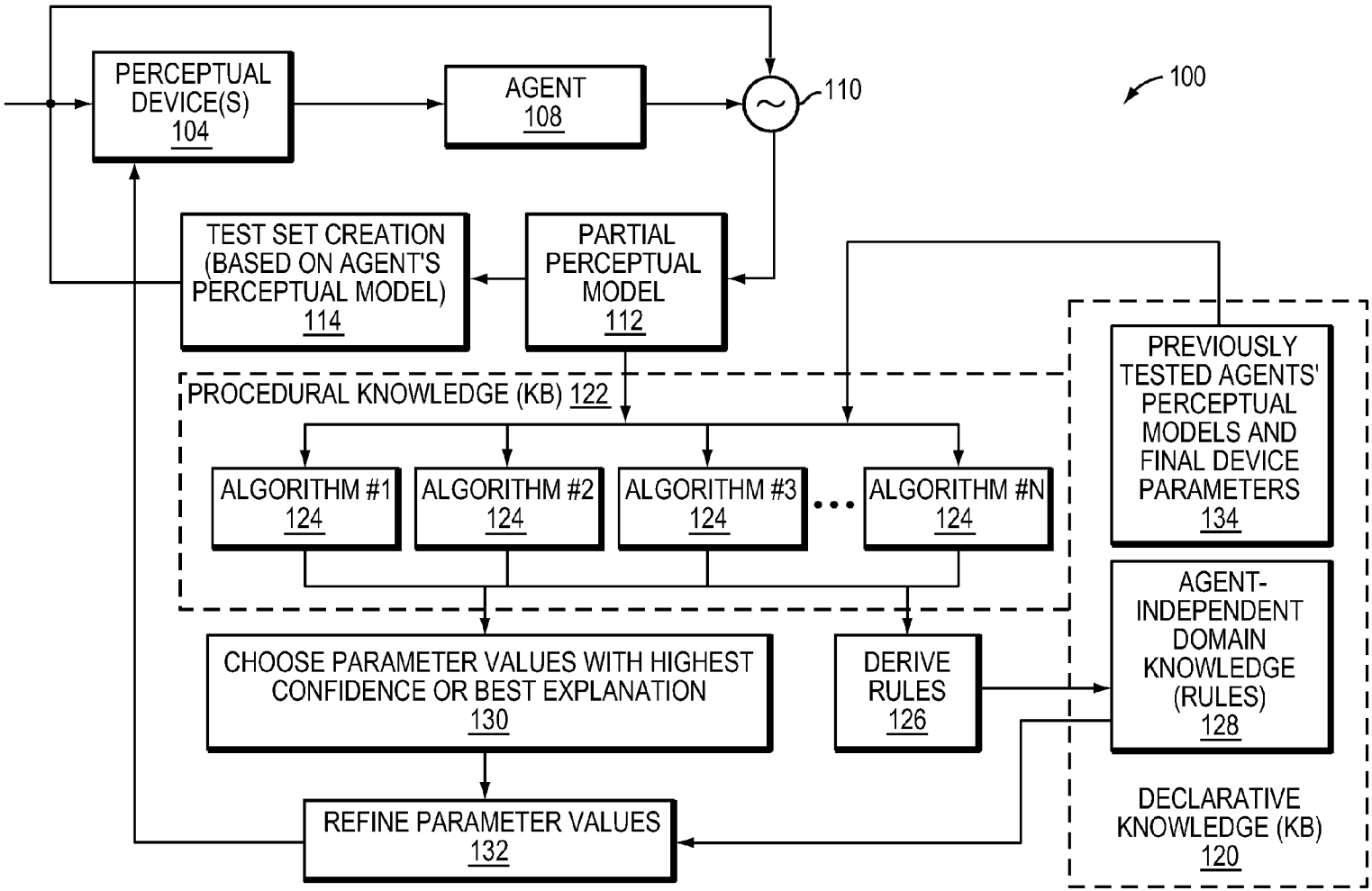
FIG. 3 is the schematic diagram of FIG. 2 incorporating a knowledge base in accordance with one embodiment of the present invention.

FIG. 3 presents another embodiment of the present invention incorporating a knowledge base into the computer program 100 of FIG. 2. The knowledge base (KB) of the computer program 100 stores knowledge in two forms—declarative 120 and procedural 122. Declarative knowledge 120 is stored as a set of statements useful for predicting a new set of parameter values 132 based on the model of the agent's perceptual ability. An example of declarative knowledge would include a situation where the agent 108 is a human with hearing loss, the device 104 is a CI, and his model 112 shows that he is weak in hearing the middle range of the frequency spectrum. In this case, the declarative knowledge 120 would include a statement that more CI channels should be associated with frequencies in that middle range than the higher or lower frequency ranges. Declarative knowledge can be readily applied, wherever appropriate, to make an inference. Often a user's previously tested parameters and device parameters 134 may be utilized with the declarative knowledge.

Procedural knowledge 122 is stored as procedures or algorithms that study the perceptual model 112 in order to make predictions for new parameter values. Each item of procedural knowledge is an independent algorithm 124 that studies the model 112 in a way which might involve certain assumptions about the model 112. These items of procedural knowledge may also utilize declarative knowledge 120 to study the model 112. Upon studying a model 112 and comparing it with the stored models of previously tested similar agents using similar devices, the algorithms may derive new rules 126 for storage as items of declarative knowledge 128. An example of procedural knowledge would include a situation where the agent is a human with hearing loss and the device is a CI. In this case, his model might be studied by an algorithm assuming that there exists a region in the model that represents the perceptual error minima of the agent. Hence, the algorithm will study the model hoping to find that minimum region and will predict appropriate parameter values for that minimum.

For any complicated perceptual device, the number of adjustable parameters can be large. The number of tests required to tune these parameters may even increase exponentially with the number of device parameters. One of the challenges faced by the proposed method is to reduce the number of tests so that the time required for tuning the parameter values can be reduced to a practical time period. One way to make the process more efficient is to utilize procedural knowledge 122. In the depicted embodiment, a number of procedures, lookup tables, or algorithms 124 with very different assumptions are contemporaneously applied to the model 112. After application, each procedure provides its prediction of the parameters along with a confidence value for the prediction and an explanation of how the prediction was reached. These explanations are evaluated, either by a supervisory program or a tester, and that prediction that provides the best explanation is selected 130. By diversifying the assumptions used in studying the model 112, the chance of the method making inferior predictions may be significantly reduced. Since the different procedures essentially "compete" against each other, the resulting prediction is often better than the prediction reached by any single procedure operating alone. New items of procedural knowledge can be added to the system at will.

Figure 4:
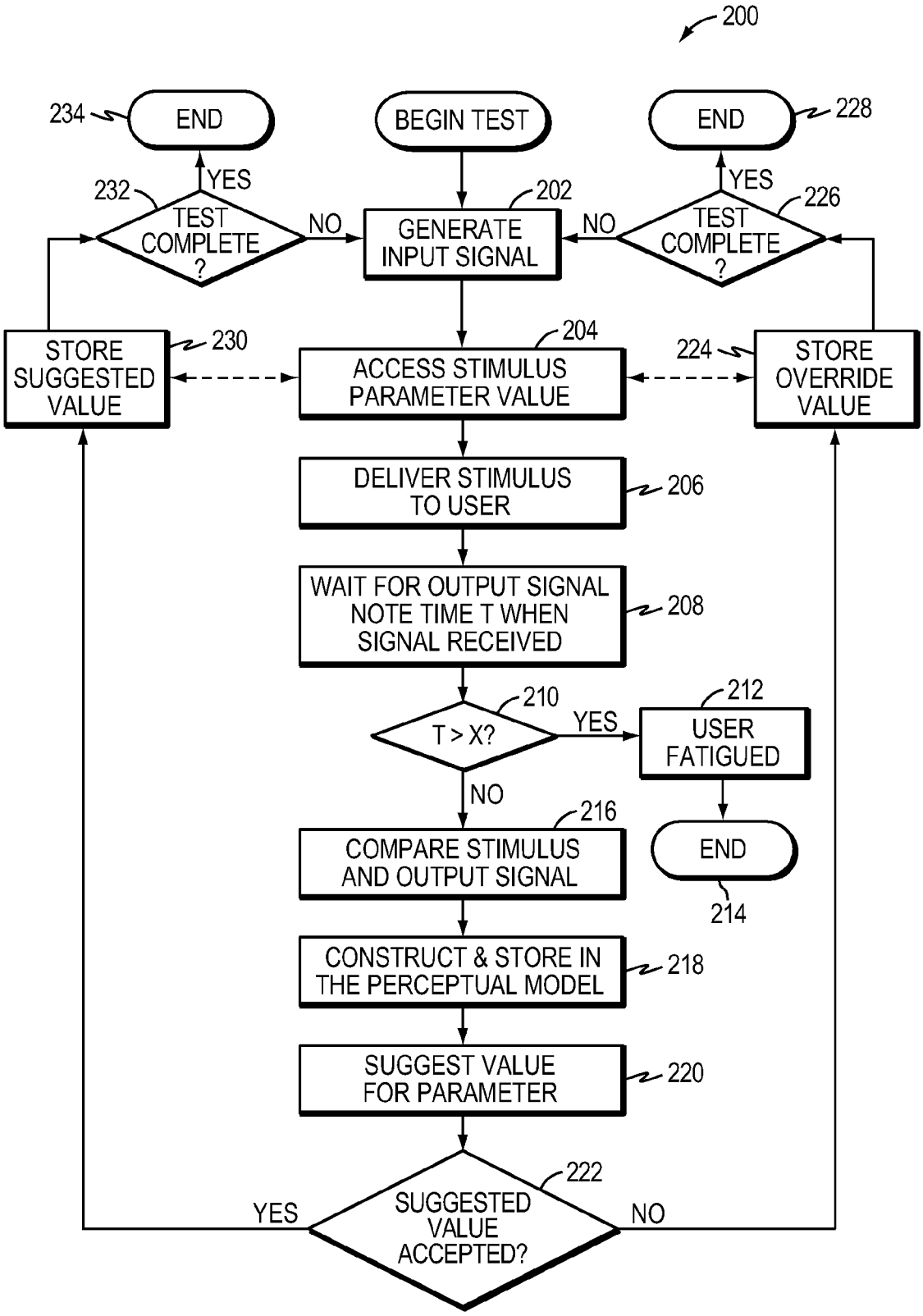
FIG. 4 is a flowchart of a testing procedure in accordance with one embodiment of the present invention.

FIG. 4 depicts an exemplary testing procedure 200 in accordance with one embodiment of the present invention. In this example, a user fitted with a CI is tested in the presence of an audiologist, who is monitoring the test. The program begins by generating an input signal 202. This input signal directs the CI to deliver a stimulus (e.g., a phoneme sound) to the user. Prior to sending the stimulus, however, the stimulus parameter value is accessed 204 by the program. This value may be either a factory default setting (usually when the device is first implanted), a previously stored suggested value, or a previously stored override value. The latter two values are described in more detail below.

A stimulus based on the parameter is then delivered to the user 206. The program waits for an output signal from the user 208. This received output signal may take any form that is usable by the program. For example, the user may repeat the sound into a microphone, spell the sound in a keyboard, or press a button or select an icon that corresponds to their perception of the sound. The program notes the time T when the output signal is received.

Upon receipt of the output signal from the user, the elapsed time is compared to a predetermined value 210. If the time exceeds this value, the program determines that the user is fatigued 212, and the program ends 214. If the elapsed time does not exceed the threshold, however, the output signal and stimulus are compared 216 to begin analysis of the results. The difference between the output signal from the user and the stimulus sent from the CI to the user are used to construct the perceptual model 218. Next, the program suggests a value for the next parameter to be tested 220.

At this point, the audiologist may optionally decide whether or not to utilize the suggested value 222 for the next test procedure, based on his or her knowledge base or other factors that may not be considered by the program. If the audiologist overrides the suggested value with a different value, this override value is stored 224 to be used for the next test. The program then determines if the test is complete 226, and may terminate the test 228 if required or desired by the user.

The test may be determined to be complete for a number of reasons. For example, the user or audiologist may be given the option at this point (or at any point during the test) to terminate testing. The program may determine that during one or more iterations of the test, the user's response time, as measured in step 210, increased such that fatigue may be a factor, warranting termination of the testing. Additionally, the program may determine that, based on information regarding the tested device or the program itself, all iterations or options have been tested. In such a case, the program may determine that no further parameter adjustment would materially improve the operation of the device or the program. Also, the program may interpret inconsistent information at this point as indicative of an error condition that requires termination. Other procedures for terminating testing are known to the art.

Returning to step 222, if the suggested value is accepted, this value is then stored for later use in a subsequent test 230. In an alternative embodiment of the program, the program may be operated without the assistance of an audiologist. In this case, acceptance of the suggested value would be the default response to the suggested value. In this way, the test may be utilized without the involvement of an audiologist. Thus, the program, with few modifications, could allow the user to self-tune his device remotely, potentially over an internet connection or with a stand-alone tuning device. After the suggested value is stored, a determination to continue the test 232 (having similar considerations as described in step 226), may be made prior to ending the test 234.

The optimization methods of the current invention may be utilized with virtually any metric that may be used to test people that utilize digital hearing devices. One such metric is disclosed in, for example, U.S. Pat. No. 7,206,416 to Krause et al., the entire disclosure of which is hereby incorporated by reference herein in its entirety, and will be discussed herein as one exemplary application of the optimization methods.

Figure 5:
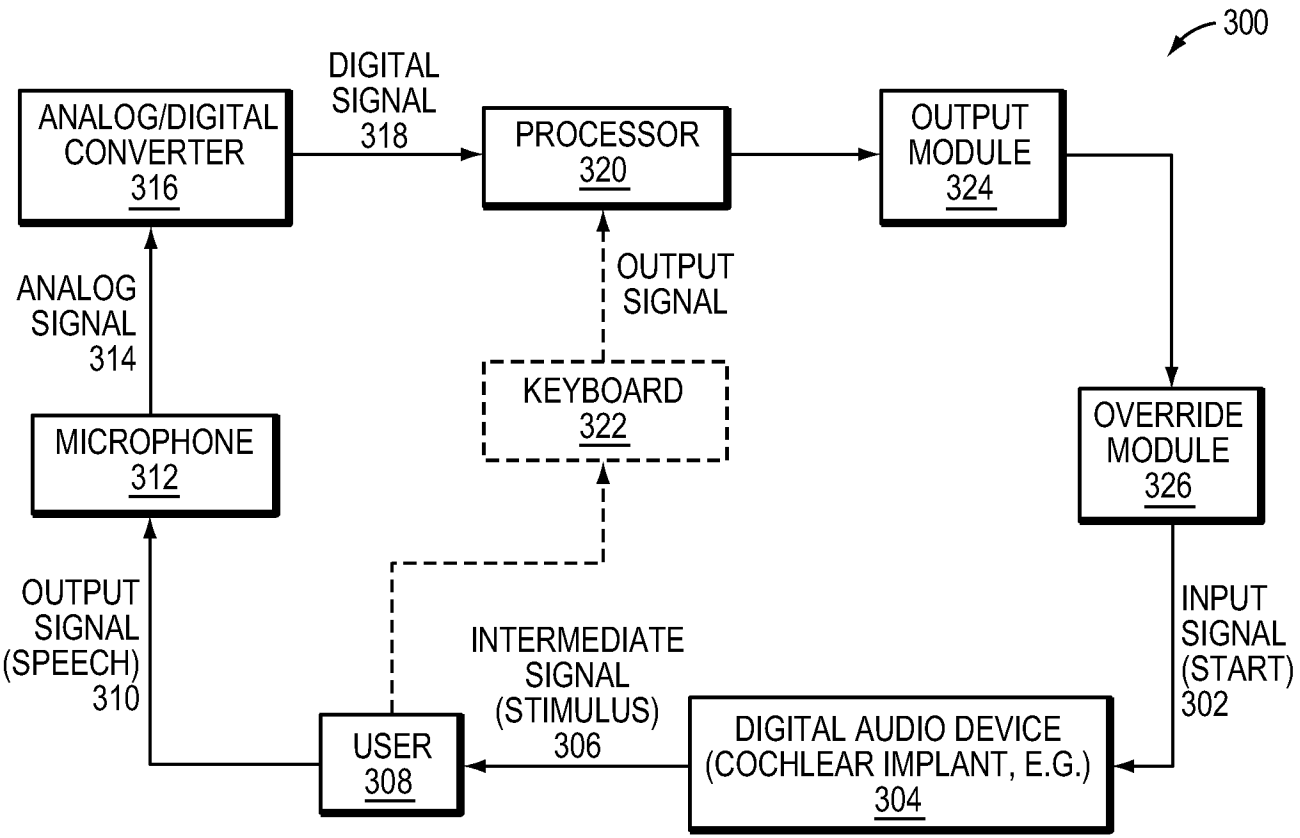
FIG. 5 is a schematic diagram of a testing system in accordance with one embodiment of the present invention.

A typical testing system 300 is depicted in FIG. 5. The testing procedure tests the raw hearing ability, independent of context and background knowledge, of a hearing-impaired person. As the procedure begins, an input signal 302 is generated and sent to a digital audio device, which, in this example, is a CI 304. Based on the input signal, the CI will deliver an intermediate signal or stimulus 306, associated with one or more parameters, to a user 308. At the beginning of a test procedure, the parameters may be factory-default settings. At later points during a test, the parameters may be otherwise defined, as described below. In either case, the test procedure utilizes the stored parameter values to define the stimulus (i.e., the sound).

After a signal is presented, the user is given enough time to make a sound signal representing what he heard. The output signal corresponding to each input signal is recorded along with the response time. If the response time exceeds a predetermined setting, the system determines that the person may be getting fatigued and will stop the test. The output signal 310 may be a sound repeated by the user 308 into a microphone 312. The resulting analog signal 314 is converted by an analog/digital converter 316 into a digital signal 318 delivered to the processor 320. Alternatively, the user 308 may type a textual representation of the sound heard into a keyboard 322. In the processor 320, the output signal 310 is stored and compared to the immediately preceding stimulus.

Based on the user response, an algorithm, lookup table, or other procedure, decides the user's strengths and weaknesses and stores this information in an internal perceptual model. Additionally, the algorithm suggests a value for the next test parameter, effectively choosing the next input sound signal to be presented. This new value is delivered via the output module 324. If an audiologist is administering the test, the audiologist may choose to ignore the suggested value, in favor of their own suggested value. In such a case, the tester's value would be entered into the override module 326. Whether the suggested value or the tester's override value is utilized, this value is stored in a memory for later use (likely in the next test). These tests may be repeated with different sounds until the CI performance is optimized or otherwise modified, the user fatigues, etc. In one embodiment, the test terminates when the user's strengths and weaknesses with respect to the current CI device parameters are comprehensively determined. A new test starts with the CI device set to new parameter values.

The disclosed system utilizes any number of algorithms that may operate substantially or completely in parallel to suggest parameter values in real time. Exemplary algorithms include (1) computing a reduced set of phonemes (input sound signals) for testing a person based on his strengths and weaknesses from past tests and using the features of the phonemes, thereby reducing testing time considerably; (2) computing a measure of performance for a person from his tests involving features of phonemes and their weights; (3) classifying a person based on their strengths and weaknesses as obtained from previous tests; and (4) predicting the parameter setting of a CI device to achieve optimum hearing for a person using his perceptual model and similar people's optimal device settings. In addition to these algorithms, other embodiments utilize alternative methodologies or procedures to compute parameter values. For example, predetermined parameter values may be selected from a lookup table containing parameter value combinations based on a person's known or predicted strengths and weaknesses based on results from tests.

In human language, a phoneme is the smallest unit of distinguishable speech. Phonemes may be utilized in testing. For example, the input signal may be chosen from a set of phonemes from the Iowa Medial Consonant Recognition Test. Both consonant phonemes and vowel phonemes may be used during testing, though vowel phonemes may have certain disadvantages in testing: they are too easy to perceive and typically do not reveal much about the nature of hearing loss. It is known that each phoneme is characterized by the presence, absence or irrelevance of a set of nine features—Vocalic, Consonantal, Compact, Grave, Flat, Nasal, Tense, Continuant, and Strident. These features are arranged hierarchically such that errors in recognizing a feature "higher" up in the hierarchy would result in more speech recognition problems because it would affect a greater number of phonemes.

A person's performance in a test can be measured by the number of input sound signals (i.e., phonemes, although actual words in any language may also be used) he fails to perceive. This type of basic testing, however, may fail to capture the person's strengths and weaknesses because many phonemes share similar features. For example, the phonemes '\f' and '\p' differ only in one out of the nine features called Continuant. A person who fails to perceive '\p' due to an error in any feature other than Continuant will also fail to perceive '\f' and vice versa. Thus, counting the number of phoneme errors would obtain less accurate results because feature errors are giving rise to phoneme errors. Due to the same reason, in order to reduce the phoneme errors, it may be desirable to focus testing on the feature errors.

In the present invention, a person's performance in a test is measured by the weighted mean of the feature errors, given by:

$$\xi = \frac{\sum_{i=1}^{9} w_i n_i}{\sum_{i=1}^{9} w_i} \tag{i}$$

where $w_i$ is the weight and $n_i$ is the number of errors in the ith feature of the hierarchy. The weights of the features are experimentally ascertained to be {0.151785714, 0.151785714, 0.142857143, 0.098214286, 0, 0.142857143, 0.125, 0.125, 0.0625}. Other weights may be utilized as the testing procedures evolve for a given user or group of users. The actual weight utilized in experimentation to optimize may include other values and potentially may be dependent upon testing, the language being used, and other variables. Acceptable results may be obtained utilizing other weightings.

This manner of testing provides a weighted error representing the user's performance with a set of parameter values. If a person is tested with all possible combinations of parameter values, the result can be represented as a weighted error surface in a high-dimensional space, where the dimension is one more than the number of parameters being considered. In this error surface, there exists a global minimum and one or more local minima. In general, while the person's performance is good at each of these local minima, his performance is the best at the global minimum. One task of the computer program is to predict the location of the global minimum or at least a good local minimum within a short period of testing.

The perceptual model may be represented in a number of ways, such as using a surface model, a set of rules, a set of mathematical/logical equations and inequalities, and so on, to obtain results. In the case of the surface model, due to the presence of many parameters, a very high-dimensional error surface may be formed. The minimum amount of data required to model such a surface increases exponentially with the number of dimensions leading to the so-called "curse of dimensionality." There is therefore an advantage to reducing the number of parameters. In one embodiment, the large number of parameters are reduced to three—"stimulation rate," "Q-value," and "map number." The stimulation rate and Q-value can dramatically change a person's hearing ability. The map number is an integer that labels the map and includes virtually all device parameters along with a frequency allocation table. Changing any parameter value or frequency allocation to the different channels would constitute a new map with a new map number. Thus, the error surface is reduced to a four-dimensional space, thereby considerably reducing the minimum amount of data required to model the surface. Each set of three parameter values constitutes a point. Only points at which a person has been tested, called sampled points, have a corresponding weighted error. The error surface is constituted of sampled points.

Adjusting parameters to reduce errors in one feature may lead to an increase in error in another feature. In order to adjust parameters such that the overall performance is enhanced, one should strive to reduce the total weighted error as described by equation (i).

While there have been described herein what are to be considered exemplary and preferred embodiments of the present invention, other modifications of the invention will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the invention. Accordingly, what is desired to be secured by Letters Patent is the invention as defined and differentiated in the following claims.

What is claimed is:

1. A method for modifying a controllable stimulus generated by a perceptual device in communication with a human user, the method comprising:

generating an input signal to the perceptual device, the perceptual device sending a stimulus to the human user, the stimulus defined at least in part by a parameter, the parameter comprising a value;

receiving an output signal from the human user, the output signal based at least in part on a perception of the stimulus by the human user;

determining a difference between the input signal and the output signal;

constructing a perceptual model based at least in part on the difference;

performing a plurality of independent algorithms on the perceptual model, wherein the plurality of independent algorithms provide at least one parameter value; and suggesting a new value for the parameter based at least in part on the at least one parameter value provided by the plurality of independent algorithms.

2. The method of claim 1, further comprising generating a second input signal to the perceptual device based at least in part on the perceptual model.

3. The method of claim 1, wherein the input signal is an audio signal.

4. The method of claim 1, wherein the stimulus is an audio signal.

5. The method of claim 1, further comprising formulating a rule based at least in part on the perceptual model.

6. The method of claim 1, wherein suggesting the new value further comprises utilizing a knowledge base.

7. The method of claim 6, wherein the knowledge base comprises at least one of declarative knowledge and procedural knowledge.

8. The method of claim 1, wherein the perceptual device is a digital audio device.

9. A system for modifying a controllable stimulus generated by a perceptual device in communication with a human user, the system comprising:

a test set generator for generating a test set to the perceptual device, the perceptual device sending a stimulus to the human user, the stimulus defined at least in part by a parameter, the parameter comprising a value;

a signal receiver for receiving an output signal from the human user, the output signal based at least in part on a perception of the stimulus by the human user;

a perceptual model module for constructing a perceptual model based at least in part on a difference between the stimulus and the output signal; and a parameter generator for suggesting a new value for the parameter based at least in part on the perceptual model, wherein suggesting the value for the parameter comprises:

performing a plurality of independent algorithms on the perceptual model, wherein the plurality of independent algorithms provide at least one parameter value; and suggesting a new value for the parameter based at least in part on the at least one parameter value provided by the plurality of independent algorithms.

10. The system of claim 9, further comprising a second test set generator for generating a second test set to the perceptual device based at least in part on the perceptual model.

11. The system of claim 9, wherein the stimulus is an audio signal.

12. The system of claim 9, further comprising a storage module for storing information used in the construction of the perceptual model.

13. The system of claim 12, wherein the information stored in the storage module comprises a knowledge base.

14. The system of claim 9, further comprising a rule extraction module for formulating a rule based at least in part on the perceptual model.

15. The system of claim 12, wherein the parameter generator suggests the new value for the parameter based at least in part on at least one of information obtained from the storage module and information obtained from the perceptual model module.

16. The system of claim 10, wherein the test set generator comprises the second test set generator.

17. An article of manufacture having computer-readable portions embodied thereon for modifying a controllable stimulus generated by a perceptual device in communication with a user, the article comprising:

computer readable instructions for providing an input signal to the perceptual device, the perceptual device sending a stimulus to the human user, the stimulus defined at least in part by a parameter, the parameter comprising a value;

computer readable instructions for receiving an output signal from the human user, the output signal based at least in part on a perception of the stimulus by the human user;

computer readable instructions for determining a difference between the input signal and the output signal;

computer readable instructions for constructing a perceptual model based at least in part on the difference;

computer readable instructions for performing a plurality of independent algorithms on the perceptual model, wherein the plurality of independent algorithms provide at least one parameter value; and computer readable instructions for suggesting a new value for the parameter based at least in part on the at least one parameter value provided by the plurality of independent algorithms.

18. The article of manufacture of claim 17, further comprising computer readable instructions for providing a second input signal to the perceptual device based at least in part on the perceptual model.

19. The article of manufacture of claim 17, wherein the input signal is an audio signal.

20. The article of manufacture of claim 17, wherein the stimulus is an audio signal.

* * * * *